United States Patent [19]

Martin

[11] 4,401,526

[45] Aug. 30, 1983

[54] ZINC ALLOY PLATING BATHS WITH CONDENSATION POLYMER BRIGHTENERS

[75] Inventor: Sylvia Martin, Detroit, Mich.

[73] Assignee: Occidental Chemical Corporation, Warren, Mich.

[21] Appl. No.: 381,089

[22] Filed: May 24, 1982

[51] Int. Cl.[3] ..... C25D 3/56

[52] U.S. Cl. ..... 204/43 Z; 204/43 T

[58] Field of Search ..... 204/55 R, 55 Y, 43 Z, 204/43 T, 114, 123

[56] References Cited

U.S. PATENT DOCUMENTS 4,229,268 10/1980 Lowery et al. ..... 204/55 R

*Primary Examiner*—G. L. Kaplan

*Attorney, Agent, or Firm*—Richard P. Mueller

[57] ABSTRACT

A zinc alloy plating bath comprises a conductive aqueous solution containing zinc ions and nickel and/or cobalt ions and a brightening additive which is a derivative of $\beta$-aminopropionic acid or a polymer thereof. A semi-bright to bright zinc alloy deposit can be electrodeposited from the bath onto a substrate.

21 Claims, No Drawings

ZINC ALLOY PLATING BATHS WITH CONDENSATION POLYMER BRIGHTENERS

BACKGROUND OF THE INVENTION

The present invention relates to a zinc alloy electroplating bath and the process of electroplating a zinc alloy onto a conductive substrate using the bath. More particularly, the present invention relates to improved compositions and processes for the electro-deposition of zinc alloy from zinc alloy plating baths comprising a water soluble derivative of $\beta$-amino-propionic acid.

Electro-deposited zinc alloy of a semi-bright to a lustrous appearance is desirable to provide a decorative plating appearance while simultaneously imparting excellent corrosion protection. Generally speaking, zinc alloys can be deposited on a conductive substrate by means of a zinc alloy electroplating bath; such as a zinc-nickel, zinc-cobalt, or zinc-nickel-cobalt bath. Zinc alloy plating baths and processes are employed to provide zinc alloy deposits on a variety of substrates and are often used in conjunction with ferrous substrates such as iron or steel.

The zinc alloy plating bath and process of the present invention involves use of a brightening additive which can be used in a wide variety of types of zinc alloy plating baths over broad pH and current density ranges to provide a semi-bright to bright zinc alloy deposit having excellent ductility characteristics. The zinc alloy plating bath of the present invention is commercially useful and is characterized, in part, by its flexibility and versatility in use to obtain excellent zinc alloy plating results.

A further understanding of the present invention will be obtained from the following description and examples thereof. Unless otherwise indicated, in the following description and examples, all parts and percents are by weight and all temperatures are in degrees Farenheit.

SUMMARY OF THE INVENTION

In accordance with the present invention, a zinc alloy electroplating bath comprises a conductive aqueous solution containing zinc ions, nickel and/or cobalt ions, and a brightening amount of a soluble brightening additive selected from the group consisting of a monomer of the following general formula and polymers thereof:

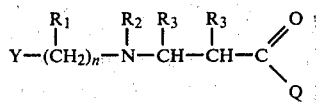

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

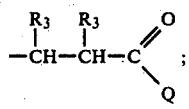

$R_3$ is H or an alkyl group having from 1 to about 4 carbon atoms, phenyl, substituted-phenyl, or

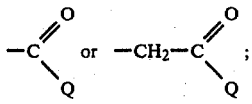

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

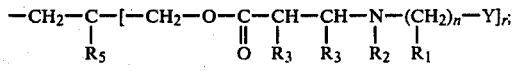

$R_5$ is H, —OH, or a hydroxyalkyl group having from 1 to about 4 carbon atoms;

r is 1 to about 3;

and mixtures thereof.

In accordance with the process of the present invention, a zinc alloy plate is electroplated from the aforesaid electroplating bath.

DETAILED DESCRIPTION OF THE INVENTION

The present invention pertains to zinc alloy electroplating baths comprising an organic brightening additive as set forth herein and to processes employing zinc alloy electroplating baths comprising said additive for electroplating a zinc alloy deposit therefrom. An organic brightening additive of the present invention is a derivative of $\beta$-aminopropionic acid or a polymer thereof. Generally speaking, the organic additive used in this invention has a long working life and is effective over a wide current density range. Furthermore, the additive is stable to relatively high temperatures even though the additive is an organic compound. Therefore, a zinc alloy electroplating bath of this invention can be useful over a wide range of current density, pH and temperature and have a long working life.

Other than use of the aforementioned brightening agent, zinc alloy baths of the present invention can comprise any of the ingredients necessarily employed in zinc alloy electroplating baths. Zinc alloy electroplating baths of different types generally speaking contain zinc ions in combination with either nickel ions or cobalt ions or a mixture of nickel ions and cobalt ions to provide the desired zinc-nickel, zinc-cobalt or zinc-nickel-cobalt alloy deposit or plate upon electrodeposition.

Zinc ions, in accordance with conventional practice, can be introduced into the aqueous solution in the form of an aqueous soluble zinc salt, such as zinc sulfate, zinc chloride, zinc fluoroborate, zinc sulfamate, zinc acetate, or mixtures thereof to provide an operating zinc ion concentration ranging from about 15 g/l to about 225 g/l with concentrations of about 20 g/l up to 100 g/l being preferred. The nickel and/or cobalt ions, also in accordance with conventional practice, can be introduced into the aqueous solution in the form of the aqueous soluble salt of nickel or cobalt such as the chloride, sulfate, fluoroborate, acetate, or sulfamate salts or mixtures thereof. Either, or a combination of both, nickel and cobalt ions can be used herein. To produce an alloy deposit containing about 0.1% to about 30% of each of nickel and/or cobalt, each should be employed in the bath in amounts of from about 0.5 g/l to about 120 g/l. Preferably, the alloy deposit contains from about 2% to about a total of 20% of both nickel and/or cobalt, and the bath contains nickel and/or cobalt ion in an amount of from about 4 g/l to about 85 g/l respectively.

Zinc alloy baths may also contain various other additives or agents. In some cases a particular additive or agent may be useful for more than one purpose. Examples of additional ingredients which may be employed in the zinc alloy baths include buffers and bath modifiers such as boric acid, acetic acid, ammonium sulfate, sodium acetate, ammonium chloride and the like. For chloride containing baths, carriers such as polyoxylated ethers such as alcohols, phenols, naphthols or acetylenic glycols may be added. Aromatic carbonyl compounds such as chlorobenzaldehyde, cinnamic acid, benzoic acid, or nicotinic acid may also be used to enhance leveling and brightness. Zinc alloy baths may also contain conductive salts, such as ammonium sulfate, ammonium chloride or bromide, ammonium fluoroborate, magnesium sulfate, sodium sulfate, and the like, to improve the conductivity of the bath. Additional supportive additives such as aluminum sulfate, polyacrylamides, thioureas, or the like may also be added to the bath to improve the crystal structure of the zinc alloy plate obtained and provide the desired appearance to the alloy deposit. Neutral baths may contain common chelating agents to keep the metal ions in solution. The preferred chelating agents are citric acid, gluconic acid, glucoheptanoic acid, tartaric acid as well as their alkali metal, ammonium, zinc, cobalt, or nickel salts. Also triethanolamine may be used. The quantities used should be enough to keep the metals in solution at pH 6.6–8.9.

The pH of the zinc alloy bath is preferably adjusted by employing an acid corresponding to the zinc salt used. Thus, depending upon the particular zinc salt in the bath, sulfuric acid, hydrochloric acid, fluoroboric acid, acetic acid, sulfamic acid, or the like, can be added to the bath to provide an operating pH of from about 0 up to about 6.5 for acid baths, preferably from about 0.5 up to about 5.5. For neutral baths of pH 6.5–8.9, complexing agents have to be used and the pH can be adjusted via alkaline metal or ammonium hydroxides or carbonates.

It is also contemplated that the bath of the present invention can further incorporate controlled amounts of other compatible brightening agents of the types that could be employed in zinc alloy plating solutions. Included among such supplemental and optional brightening agents are aromatic carbonyl compounds, thioureas or N-substituted derivatives thereof, cyclic thioureas, polyacrylamides, and the like.

In addition, aluminum ion can be introduced into the bath by an aqueous soluble salt thereof, such as aluminum sulfate, to obtain an enhanced brightening effect. Aluminum ion can suitably be employed in a concentration of from about 0.5 mg/l up to about 200 mg/l, preferably from about 4 mg/l up to about 40 mg/l.

To further enhance the corrosion resistance of the alloy deposit, small amounts of trace metals which will codeposit with the zinc alloy may be added to the electrolyte. For example, soluble salts of chromium, titanium, tin, cadmium, or indium may be added to the bath in amounts of 5 mg/l to 4 g/l.

In addition to the above components, an electroplating bath of the present invention includes a brightening amount of an organic brightening additive selected from the group consisting of a compound of the following general formula and polymers thereof:

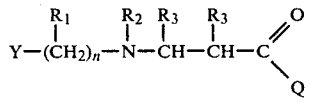

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

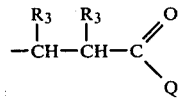

$R_3$ is H or an alkyl group having from 1 to about 4 carbon atoms, phenyl, substituted-phenyl, or

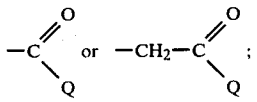

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

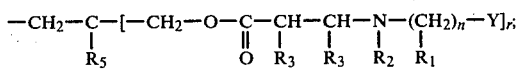

$R_5$ is H, —OH, or a hydroxyalkyl group having from 1 to about 4 carbon atoms;

r is 1 to about 3;

and mixtures thereof.

Both monomers and polymers of compounds of the above general formula are useful as brightening additives in baths and processes of this invention but polymers are preferred. Where polymers are employed herein, the exact molecular weight of the polymer or degree of polymerization is not believed to be critical.

The brightening agent must, however, be water soluble, which sets a functional upper limit of molecular weight or degree of polymerization. Generally speaking, therefore, the molecular weight of the brightening additive of the present invention can vary from the molecular weight of the monomer to a molecular weight at which the polymer becomes water insoluble.

Brightening additives of the present invention can be made by the Michael Reaction, for example, by reacting a conjugated carbonyl compound, preferably carboxylic derivative such as an acrylic derivative, with a 1° or 2° amine (or its derivatives) without a basic catalyst and preferably in a polar solvent in an exothermic reaction. The polymer can then be made by heating for polymerization, after which unwanted by-products can be removed by an appropriate means such as by distillation. The polymer product is a cross-linked polymer which generally is a thick jelly, soluble in water.

Organic compounds of the above general formula and methods for making them are disclosed in Ogata et al., "The Reaction of Amino Alcohols With Acrylates," *Bulletin of the Chemical Society of Japan,* Vol. 39, 1486–1490 (1966); Sanui et al., "The Catalytic Effect and Alcohol and Mercaptan on the Michael Reaction of Acrylates," *Bulletin of the Chemical Society of Japan,* Vol. 40, 1727 (1967); Ogata et al. "A Novel Synthesis of Polyamide from Amino Alcohol and Acrylate," *Polymer Letters,* Vol. 4, 273–276 (1966); and Ogata et al. "Room-Temperature Polycondensation of β-Amino Acid Derivatives VI. Synthesis of Various N-(Hydroxyethyl) Nylons*," *Journal of Polymer Science: Part A*-1, Vol. 7, 2817–2858 (1969).

Specific brightening additives of the present invention which are preferred for use herein include:

Poly[N-(2-hydroxyethyl) nitrilo di-(ethylpropionate)];

Poly[N-(2-hydroxyethyl) nitrilo di-(N'-2-hydroxyethyl)propionamide];

Poly[N-(2-hydroxyethyl)-N-(2-cyanoethyl)-β-amino propionic acid];

Tetra[N-methyl N-cyanomethyl β-amino propionate]-pentaerythritol;

Poly[N-(hydroxy tert-butyl)β-amino β-methylcarboxy methyl propionate];

Poly[N-(2-hydroxypropyl)β-amino-α-methyl aceto methyl propionate];

Poly[N-(2-hydroxyethyl)β-amino-β-phenyl methyl propionate];

Poly[β-tauryl ethyl propionate];

Poly[N,N-di(2-hydroxyethyl)nitrilo β-methyl propionamide];

Poly[N-(3-hydroxypropyl)β-aminopropionamide-(N'-isopropylsodium sulfonate];

Poly[N-(2-mercaptoethyl) nitrilo di(methyl propionate)];

Poly[N-(2-carboxyethyl)β-amino di(butyl propionate)];

Poly[N-hydroxyethyl aminoethyl)β-amino(2-methoxyethyl)propionate];

Poly[N-(2-hydroxyethyl) nitrilo di-(2-ethyl hexyl propionate)];

N-(2-hydroxypropyl) nitrilo di-(polyethoxy propionate) where the molecular weight of the polyether group is about 4000;

Tetra[N-(2-hydroxyethyl)β-amino propionate]pentaerythritol; and mixtures thereof.

The concentration of brightening additive employed in a plating bath of this invention can vary over a broad range. The maximum amount of the brightening additive in the bath depends upon the specific additive and may be up to the limit of its solubility in the aqueous acidic plating bath. The minimum amount of brightening additive in the bath depends upon the specific additive and factors such as the current density of the plating process. Generally speaking, the brightening additive must be employed in sufficient concentration effective to obtain the brightening effect desired. For most common purposes, the brightening additive of the present invention will be present in the bath in an amount of from 0.015 to 2.0 g/l. However, at very low current density rates, the additive can be effective in very small amounts, for example, at 0.1 mg/l and at very high rates at concentrations as high as 10 g/l.

In accordance with the method of the present invention, a zinc alloy deposit is electrodeposited from a zinc alloy electroplating bath comprising the above described brightening additve in an amount effective to obtain a desirable zinc alloy deposit. The process of zinc alloy plating of the present invention is useful for decorative or industrial zinc alloy plating such as strip plating, conduit plating, wire plating, rod plating, tube or coupling plating, and so forth. Each application will require a specific form of electrolyte to be used depending on what corrosion protection or properties are desired.

Zinc alloy plating baths of the present invention can be employed over a broad range of temperatures. In use, the temperature of operation of the bath is normally between about 60° F. and 160° F. and is usually between 65° F. and 95° F.

The electrodeposition of zinc alloy from the bath can be carried out in the older conventional or newer high speed functional methods. The electroplating baths of the present invention may be used over a wide range of operating conditions since the brightening additives of the present invention can enhance the deposit of a semi-bright to bright zinc alloy plate over a wide range of pH, temperature and current density conditions. In addition, it is an advantage of the present invention that the brightening agents have a long working life and hence, baths and this invention can be economically employed.

Generally, the zinc alloy plate will be electrodeposited from the zinc alloy electroplating bath using an average cathode current density of from about 10 to 5,000 amp/ft$^2$ (ASF) with bath temperature within the range of from about 65° F. to about 160° F. The maximum cathode current density applicable is dependent upon the particular type of zinc alloy electrolyte employed. The bath may be agitated with air or agitated mechanically during plating or the workpieces may themselves be mechanically moved if such is desired. Alternatively, the plating solution may be pumped to create turbulence.

The following examples are set forth to further illustrate the present invention and the manner in which the invention may be carried out. The examples are set forth to exemplify the present invention.

EXAMPLE 1

An aqueous acid zinc alloy plating bath was formulated containing the following ingredients in the amounts indicated:

| | |
|---|---|
| zinc sulfate monohydrate | 80 g/l |
| nickel sulfate hexahydrate | 50 g/l |
| boric acid | 38 g/l |

-continued

| | |
|---|---|
| ammonium sulfate | 30 g/l |
| tetra[N—methyl-N—cyanomethyl-β-amino propionate]pentaerythritol | 2.0 g/l |

The bath was air agitated, had a pH of about 4.5, and had a temperature of about 85° F. A bright zinc alloy electroplate was obtained on steel cathodes by electrolyzing the bath at a cathode current density of 125 ASF. The zinc alloy electroplate obtained was fully bright and contained about 3% nickel.

EXAMPLE 2

An aqueous acid zinc alloy plating bath was formulated containing the following ingredients in the amounts indicated:

| | |
|---|---|
| zinc sulfate monohydrate | 200 g/l |
| nickel sulfate hexahydrate | 300 g/l |
| acetic acid | 90 g/l |
| poly[N—(2-hydroxyethyl)nitrilo di-(ethylpropionate)] | 3.2 g/l |

The bath cathode was rotationally agitated at 200 RPM, had a pH of about 2.0 and had a temperature of about 120° F. A zinc alloy electroplate was obtained on steel cathodes by electrolyzing the bath at a cathode current density of 1500 ASF. The zinc alloy electroplate obtained was fully bright and contained about 6.9% nickel.

EXAMPLE 3

An aqueous acid zinc alloy plating bath was formulated containing the following ingredients in the amounts indicated:

| | |
|---|---|
| zinc sulfate monohydrate | 100 g/l |
| cobalt sulfate hexahydrate | 50 g/l |
| boric acid | 30 g/l |
| poly[N—(2-hydroxyethyl)nitrilo-di N'—(ethylpropionate)] | 1.0 g/l |

The bath was air agitated, had a pH of about 3.5 and had a temperature of about 75° F. A bright zinc alloy electroplate was obtained on steel cathodes by electrolyzing the bath at a cathode current density of 50 ASF. The zinc alloy electroplate obtained was bright and contained about 1.2% cobalt.

EXAMPLE 4

An aqueous acid zinc alloy plating bath was formulated containing the following ingredients in the amounts indicated:

| | |
|---|---|
| zinc chloride | 120 g/l |
| nickel chloride.$6H_2O$ | 26 g/l |
| acetic acid | 1.5% |
| aluminum sulfate | 0.2 g/l |
| poly[N—(2-hydroxyethyl)nitrilo di (ethyl propionate)] | 1.6 g/l |

The bath cathode was rotationally agitated at 1000 RPM, had a pH of about 3.5 and had a temperature of about 90° F. A zinc alloy electroplate was obtained on steel cathodes by electrolyzing the bath at a cathode current density of about 200 ASF. The zinc alloy obtained was fine grained, semi-bright and contained about 1.6% nickel.

EXAMPLE 5

An aqueous neutral zinc alloy plating bath was formulated containing the following ingredients in the amounts indicated:

| | |
|---|---|
| $CoSO_4.7H_2O$ | 20 g/l |
| $ZnSO_4.H_2O$ | 31 g/l |
| sodium glucoheptonate | 60 g/l |
| poly[N—(2-hydroxyethyl)nitrilo di (2-ethyl hexylpropionate)] | 1.6 g/l |
| triethanolamine | 4 ml/l |
| pH = 8.7 | |

A nickel plated steel Hull Cell panel is plated at room temperature at 2 amps for 5 minutes at 78° F. The panel is fully bright all the way across and has a very attractive color.

EXAMPLE 6

An aqueous acid zinc alloy plating bath was formulated containing the following ingredients in the amounts indicated:

| | |
|---|---|
| zinc sulfate monohydrate | 68 g/l |
| nickel sulfate hexahydrate | 357 g/l |
| boric acid | 34 g/l |
| N—(2-hydroxypropyl)nitrilo di (polyethoxypropionate) | 0.5 g/l |

The pH of the bath was 0.2 and the temperature was 130° F. The bath was used for plating steel strip traveling at a speed of 300 ft./minute. The cathode current density was 1000 ASF. The zinc plate deposited was bright with a steel gray color and had a nickel content of 9.3%.

EXAMPLE 7

An aqueous acid zinc alloy plating bath was formulated containing the following ingredients in the amounts indicated:

| | |
|---|---|
| zinc sulfate monohydrate | 50 g/l |
| nickel sulfate hexahydrate | 370 g/l |
| boric acid | 34 g/l |
| acetic acid | 5 g/l |
| poly[N—(2-hydroxy)β-amino α-methylacetomethyl propionate] | 1 g/l |

The bath cathode was rotationally agitated at 1500 RPM, had a pH of about 2.5 and a temperature of 100° F. A zinc alloy electroplate was obtained on steel cathodes by electrolyzing the bath at a cathode current density of 800 ASF. The zinc alloy obtained was dark colored, semi-bright deposit and contained 27% nickel.

EXAMPLE 8

An aqueous acid zinc alloy plating bath was formulated containing the following ingredients in the amounts indicated:

| | |
|---|---|
| zinc sulfate heptahydrate | 400 g/l |
| cobalt sulfate heptahydrate | 48 g/l |
| sodium sulfate | 26 g/l |
| sodium acetate | 12 g/l |
| chromium (+3) sulfate | 1.1 g/l |

-continued

| | |
|---|---|
| poly[N—(2-hydroxyethyl)nitrilo di propionamide] | 1.0 g/l |

The pH of the bath was 4 and the temperature was 120° F. The electrolyte was pumped in a jet stream between the anode and the steel cathode which were only 0.75 inches apart. The cathode current density was 450 ASF. The cobalt content of the deposit was 0.2% and the chromium content was only 0.04%. The appearance of the cathode was bright and uniform.

While the above disclosure sets forth and describes various embodiments of the present invention, the compositions and methods described are intended to illustrate but not limit the present invention. It will be understood that the specific embodiments described herein are subject to variation and modification by one skilled in the art having benefit of the present disclosure. Therefore, it is intended that the present invention is to be limited solely by the following claims.

What is claimed is:

1. An aqueous zinc alloy electroplating bath having a pH of from about 0 up to about 8.9 and comprising a conductive aqueous solution containing zinc ions, alloying metal ion selected from the group consisting of nickel ions, cobalt ions and mixtures thereof, and a brightening amount of a brightening additive selected from the group consisting of a monomer of the following general formula and polymers thereof:

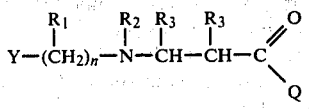

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

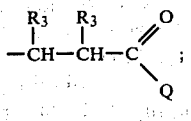

$R_3$ is H or an alkyl group having from 1 to about 4 carbon atoms, phenyl, substituted-phenyl, or

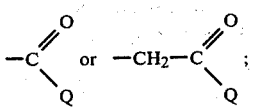

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

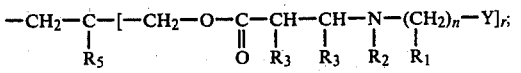

$R_5$ is H, —OH, or a hydroxyalkyl group having from 1 to about 4 carbon atoms;

r is 1 to about 3;

and mixtures thereof.

2. The bath of claim 1 wherein said brightening additive is selected from the group consisting of:

Poly[N-(2-hydroxyethyl) nitrilo di-(ethylpropionate)];

Poly[N-(2-hydroxyethyl) nitrilo di-(N'-2-hydroxyethyl)propionamide];

Poly[N-(2-hydroxyethyl)-N-(2-cyanoethyl)-β-amino propionic acid];

Tetra[N-methyl N-cyanomethyl β-amino propionate]pentaerythritol;

Poly[N-(hydroxy tert-butyl)β-amino β-methylcarboxy methyl propionate];

Poly[N-(2-hydroxypropyl)β-amino-α-methyl aceto methyl propionate];

Poly[N-(2-hydroxyethyl)β-amino-β-phenyl methyl propionate];

Poly[β-tauryl ethyl propionate];

Poly[N,N-di(2-hydroxyethyl)nitrilo β-methyl propionamide];

Poly[N-(3-hydroxypropyl)β-aminopropionamide-(N'-isopropylsodium sulfonate];

Poly[N-(2-mercaptoethyl) nitrilo di(methyl propionate)];

Poly[N-(2-carboxyethyl)β-amino di(butyl propionate)];

Poly[N-(hydroxyethyl aminoethyl)β-amino(2-methoxyethyl)propionate];

Poly[N-(2-hydroxyethyl) nitrilo di-(2-ethyl hexyl propionate)];

N-(2-hydroxypropyl) nitrilo di-(polyethoxy propionate) where the molecular weight of the polyether group is about 4000;

Tetra[N-(2 hydroxyethyl)β-amino propionate]pentaerythritol; and mixtures thereof.

3. The bath of claim 1 or 2 wherein said brightening additive is present in an amount of from about 0.1 mg/l to about 10 g/l.

4. The bath of claim 1 or 2 wherein said brightening additive is present in an amount of from about 0.015 g/l to about 2 g/l.

5. The bath of claim 1 or 2 wherein said bath has a pH of from about 0 to about 6.5.

6. The bath of claim 1 or 2 wherein said bath has a pH of from about 6.5 to about 8.9 and contains chelating agents to keep the metal ions in solution.

7. The zinc alloy electroplating bath as defined in claim 1 or 2 wherein said alloying metal ion is nickel.

8. The zinc alloy electroplating bath as defined in claim 1 or 2 wherein said alloying metal ion is cobalt.

9. The zinc alloy electroplating bath as defined in claim 1 or 2 wherein said alloying metal ion is a mixture of nickel and cobalt ion.

10. A process for electroplating a zinc alloy deposit onto a substrate comprising electrodepositing zinc alloy from a conductive aqueous solution containing zinc ions, alloying metal ions selected from the group consisting of nickel ions, cobalt ions and mixture thereof and a brightening amount of a water soluble brightening additive selected from the group consisting of a monomer of the following general formula and polymers thereof:

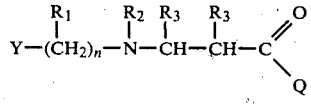

wherein:

n is from 1 to about 6;

Y is —OX, —$NX_2$, —$SO_3H$, —$SO_3M$, —COOH, —COOM, —SX, or —CN;

X is H, or an alkanol, alkamine, sulfoalkyl, carboxyalkyl, hydroxyaryl, sulfoaryl, carboxyaryl, or aminoaryl having from 1 to about 10 carbon atoms;

M is H, Li, Na, K, Be, Mg or Ca;

Q is —$OR_4$, —$N(R_4)_2$, —OZ, —OM, or halogen;

Z is an aryl group or a substituted aryl group having from about 6 to about 14 carbon atoms;

$R_1$ is H or an alkyl group having from 1 to about 4 carbon atoms;

$R_2$ is H or an alkyl, alkanol, or alkamine group having from 1 to about 4 carbon atoms, or

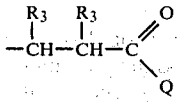

$R_3$ is H or an alkyl group having from 1 to about 4 carbon atoms, phenyl, substituted-phenyl, or

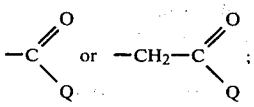

$R_4$ is H or an alkyl, alkenyl, alkynyl, alkanol, alkenol, alkynol, keto alkyl, keto alkynyl, keto alkenyl, alkamine, alkoxy, polyalkoxyl, sulfoalkyl, carboxyalkyl, mercapto alkyl, or nitriloalkyl group having from 1 to about 12 carbon atoms, phenyl or substituted phenyl or

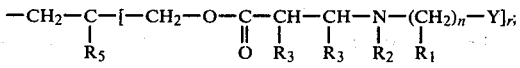

$R_5$ is H, —OH, or a hydroxyalkyl group having from 1 to about 4 carbon atoms;

r is 1 to about 3;

and mixtures thereof.

11. The process of claim 9 wherein said brightening additive is selected from the group consisting of:

Poly[N-(2-hydroxyethyl) nitrilo di-(ethylpropionate)];

Poly[N-(2-hydroxyethyl) nitrilo di-(N'-2-hydroxyethyl)propionamide];

Poly[N-(2-hydroxyethyl)-N-(2-cyanoethyl)-β-amino propionic acid];

Tetra[N-methyl N-cyanomethyl β-amino propionate]pentaerythritol;

Poly[N-(hydroxy tert-butyl)β-amino β-methylcarboxy methyl propionate];

Poly[N-(2-hydroxypropyl)β-amino-α-methyl aceto methyl propionate];

Poly[N-(2-hydroxyethyl)β-amino-β-phenyl methyl propionate];

Poly[β-tauryl ethyl propionate];

Poly[N,N-di(2-hydroxyethyl)nitrilo β-methyl propionamide];

Poly[N-(3-hydroxypropyl)β-aminopropionamide-(N'-isopropylsodium sulfonate];

Poly[N-(2-mercaptoethyl) nitrilo di(methyl propionate)];

Poly[N-(2-carboxyethyl)β-amino di(butyl propionate)];

Poly[N-(hydroxyethyl aminoethyl)β-amino(2-methoxyethyl)propionate];

Poly[N-(2-hydroxyethyl) nitrilo di-(2-ethyl hexyl propionate)];

N-(2-hydroxypropyl) nitrilo di-(polyethoxy propionate) where the molecular weight of the polyether group is about 4000;

Tetra[N-(2-hydroxyethyl)β-amino propionate]pentaerythritol; and mixtures thereof.

12. The process of claim 10 or 11 wherein said brightening additive is present in an amount of from about 0.1 mg/l to about 10 g/l.

13. The process of claim 10 or 11 wherein said brightening additive is present in an amount of from about 0.015 g/l to about 2 g/l.

14. The process of claim 10 or 11 wherein said bath has a pH of from about 0 to about 6.5.

15. The process of claim 10 or 11 wherein said bath has a pH of about 6.5 to about 8.9 and contains a chelating agent in an amount effective to keep metal ions in solution.

16. The process of claim 10 or 11 wherein said alloying metal ion is nickel.

17. The process of claim 10 or 11 wherein said alloying metal ion is cobalt.

18. The process of claim 10 or 11 wherein said alloying metal ion is a mixture of nickel and cobalt ion.

19. The process of claim 10 or 11 wherein said bath comprises a trace amount of a metal selected from the group consisting of chromium, titanium, tin, cadmium, indium and mixtures thereof.

20. The process of claim 10 or 11 wherein said bath comprises aluminum ion in an amount effective to obtain a brightening effect therefrom.

21. The process of claim 10 or 11 wherein said electrodeposition is carried out at a high current density of from about 10 to about 5000 ASF.

* * * * *

UNITED STATES PATENT AND TRADEMARK OFFICE

CERTIFICATE OF CORRECTION

PATENT NO. : 4,401,526

DATED : August 30, 1983

INVENTOR(S) : Sylvia Martin

It is certified that error appears in the above-identified patent and that said Letters Patent are hereby corrected as shown below:

In Column 1, lines 49-52;
In Column 4, lines 13-16;
In Column 9, lines 32-35; and
In Column 11, lines 8-11; the general formula depicted should appear as follows:

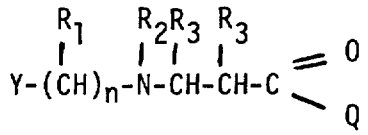

UNITED STATES PATENT AND TRADEMARK OFFICE

CERTIFICATE OF CORRECTION

PATENT NO. : 4,401,526

DATED : August 30, 1983

INVENTOR(S) : Sylvia Martin

It is certified that error appears in the above-identified patent and that said Letters Patent is hereby corrected as shown below:

In Column 2, lines 23-25;
In Column 4, lines 55-57;
In Column 10, lines 5-7; and
In Column 11, lines 52-54; the formula depicted should appear as follows:

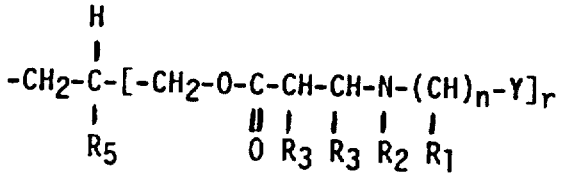

Signed and Sealed this

*Eleventh* Day of *March 1986*

[SEAL]

*Attest:*

DONALD J. QUIGG

*Attesting Officer*

*Commissioner of Patents and Trademarks*